US009435621B1

(12) United States Patent
Yeh

(10) Patent No.: US 9,435,621 B1
(45) Date of Patent: Sep. 6, 2016

(54) ARROWHEAD ASSEMBLY STRUCTURE

(71) Applicant: Pei-Ken Yeh, New Taipei (TW)

(72) Inventor: Pei-Ken Yeh, New Taipei (TW)

( * ) Notice: Subject to any disclaimer, the term of this patent is extended or adjusted under 35 U.S.C. 154(b) by 0 days.

(21) Appl. No.: 15/050,055

(22) Filed: Feb. 22, 2016

(30) Foreign Application Priority Data

Mar. 18, 2015 (TW) ..... 104204055 U

(51) Int. Cl.
*F42B 6/08* (2006.01)
*A63B 65/02* (2006.01)
*F42B 6/02* (2006.01)
*F42B 6/04* (2006.01)

(52) U.S. Cl.
CPC . *F42B 6/08* (2013.01); *F42B 6/02* (2013.01); *F42B 6/04* (2013.01)

(58) Field of Classification Search
CPC ..... F42B 6/08; F42B 6/04; F42B 6/02
USPC ..... 446/578, 582; 473/578, 582
See application file for complete search history.

(56) References Cited

U.S. PATENT DOCUMENTS 1,554,653 A * 9/1925 Poole ..... F42B 6/04 473/585
2,531,635 A * 11/1950 Maager ..... F42B 6/08 473/585
7,601,084 B2 * 10/2009 Martin ..... F42B 6/02 473/578
7,731,612 B2 * 6/2010 Martin ..... F41J 3/0004 473/581
8,012,049 B1 * 9/2011 Walterscheid ..... F42B 6/003 473/572
8,348,789 B1 * 1/2013 Walterscheid ..... F42B 6/003 473/578
8,449,413 B1 * 5/2013 Jackson ..... F42B 6/08 473/578
8,852,038 B1 * 10/2014 Hyde ..... F42B 6/04 473/578
8,932,159 B2 * 1/2015 Lennon ..... F42B 6/08 473/578
8,968,126 B2 * 3/2015 Chia ..... F42B 6/08 473/578
9,091,514 B1 * 7/2015 Cummings ..... F42B 6/02
9,194,672 B1 * 11/2015 Hyde ..... F42B 6/08
2006/0014598 A1 * 1/2006 Martin ..... F42B 6/08 473/578
2006/0276277 A1 * 12/2006 Montefusco ..... F42B 8/16 473/586
2009/0309307 A1 * 12/2009 Leal ..... A63B 63/00 273/348.4
2010/0207330 A1 * 8/2010 Yaroch ..... A63F 9/0204 273/358
2014/0256479 A1 * 9/2014 Bynum, Jr. ..... F42B 6/08 473/470
2016/0074725 A1 * 3/2016 Nally ..... F42B 6/003 473/582

* cited by examiner

*Primary Examiner* — Alexander Niconovich
(74) *Attorney, Agent, or Firm* — Wang Law Firm, Inc.

(57) ABSTRACT

An arrowhead assembly structure is connected with a front end of an arrow rod and includes: an arrowhead member, a first end of the arrowhead member being fitted on a front end of the arrow rod, the arrowhead member having a support flange and a hub section, the hub section axially extending from the support flange toward a second end of the arrowhead member, the hub section having a diameter smaller than outer diameter of the support flange; at least one first cushion member formed with a central through hole, by means of the central through hole, the first cushion member being fitted around the hub section, one end of the first cushion member being adhered to the support flange of the arrowhead member; and at least one second cushion member, a first end of the second cushion member being adhered to a second end of the first cushion member.

7 Claims, 5 Drawing Sheets

ARROWHEAD ASSEMBLY STRUCTURE

RELATED APPLICATION

This application claims the benefit of a Taiwanese patent application, 104204055, filed on Mar. 18, 2015, the specification of which is incorporated here by this reference.

BACKGROUND OF THE INVENTION

1. Field of the Invention

The present invention relates generally to an arrowhead assembly structure. The arrowhead assembly structure includes an arrowhead member, at least one first cushion member and at least one second cushion member. The second cushion member is adhered to a second end of the first cushion member. When the second cushion member hits an object, the force is fully distributed over a support flange of the arrowhead member. Therefore, the force-bearing area is effectively enlarged to avoid concentration of the force on a very small region. In this case, in the instant of hitting a target, the arrow rod will not deflect and the possibility of the accident that the arrow rod strikes and injures a player is minimized.

2. Description of the Related Art

Arrowheads are often used in a survival game (such as Archery Tag). FIG. 5 shows a conventional arrowhead. The conventional arrowhead includes: an arrow rod body 60; an arrowhead 70, one end of the arrowhead 70 having a solid boss section 71, the boss section 71 being formed with outer thread; and a foam rubber member 80. A plastic socket 81 is disposed in the foam rubber member 80. The plastic socket 81 has inner thread. One end of the arrowhead 70 is fitted on one end of the arrow rod 60. The outer thread of the solid boss 71 of the arrowhead 70 is directly screwed and locked in the inner thread of the plastic socket 81 of the foam rubber member 80.

When the conventional arrowhead hits a target, (which is usually the body of a player), the action force F acts on the target from the boss section 71 of the foremost end of the arrowhead 70 through the foam rubber member 80. Therefore, the force will concentrate on the region of the boss section 71. The force-bearing area of the front end of the boss section 71 is extremely small and serves as a fulcrum. Therefore, due to the fulcrum effect, when hitting the target, the arrow rod body 60 will very unstably deflect or tilt to one side. As a result, the hard arrow rod body 60 will strike or thrust the hit player. This will cause uncomfortableness or even accidentally cause injury of the player.

Moreover, the foam rubber member 80 of the conventional arrowhead is made of one single cushion material. Therefore, the foam rubber member 80 can hardly effectively cushion the impact force. As a result, the arrow rod body 60 will directly hit a target, (which is usually the body of a player) by a greater hitting force. In this case, in the survival game, the player hit by the arrowhead will feel uncomfortable.

It is therefore tried by the applicant to provide an arrowhead assembly structure to eliminate the shortcomings of the conventional arrowhead.

SUMMARY OF THE INVENTION

It is therefore a primary object of the present invention to provide an arrowhead assembly structure connected with a front end of an arrow rod. The arrowhead assembly structure includes: an arrowhead member, a first end of the arrowhead member being fitted on a front end of the arrow rod, the arrowhead member having a support flange and a hub section, the hub section axially extending from the support flange toward a second end of the arrowhead member, the hub section having a diameter smaller than an outer diameter of the support flange; at least one first cushion member, the first cushion member being formed with a central through hole, by means of the central through hole, the first cushion member being fitted around the hub section of the arrowhead member, one end of the first cushion member being adhered to the support flange of the arrowhead member; and at least one second cushion member, a first end of the second cushion member being adhered to a second end of the first cushion member.

In the above arrowhead assembly structure, the center of the second end of the hub section is axially recessed to forma socket. Accordingly, when the arrowhead hits a target, the action force applied to the second cushion member will not concentrate on the center, but will distribute over the outer circumferential region projected by the support flange. Therefore, when the arrowhead hits a target, the large-area outer circumferential region of the second cushion member will serve as a main force-bearing region to reduce the fulcrum effect. Under such circumstance, when the arrowhead hits the target, the possibility that the arrow rod strikes a player is minimized. Generally, in practice, when the arrowhead hits a target, the entire arrow will directly drop onto the ground and the arrow rod will not deflect. In this case, the possibility of the accident that the arrow rod strikes or thrusts and injures a player is minimized. This can ensure safety of the player when playing the survival game.

In the above arrowhead assembly structure, both the first and second cushion members are elastic members.

In the above arrowhead assembly structure, the second cushion member has an elastic constant larger than that of the first cushion member.

In comparison with the conventional arrowhead, the arrowhead assembly structure of the present invention has the following characteristics and advantages:

1. The action force can be distributed over a large area to avoid fulcrum effect caused by the smaller impact or collision area of the arrow rod. Therefore, in the instant of hitting a target, the arrow rod will not deflect and the possibility of the accident that the arrow rod strikes or thrusts and injures a player is minimized.
2. When the second cushion member hits an object, the second cushion member is compressed to the first cushion member to make a secondary cushioning for weakening the impact force.

The present invention can be best understood through the following description and accompanying drawings, wherein:

DETAILED DESCRIPTION OF THE PREFERRED EMBODIMENTS

Figure 1:
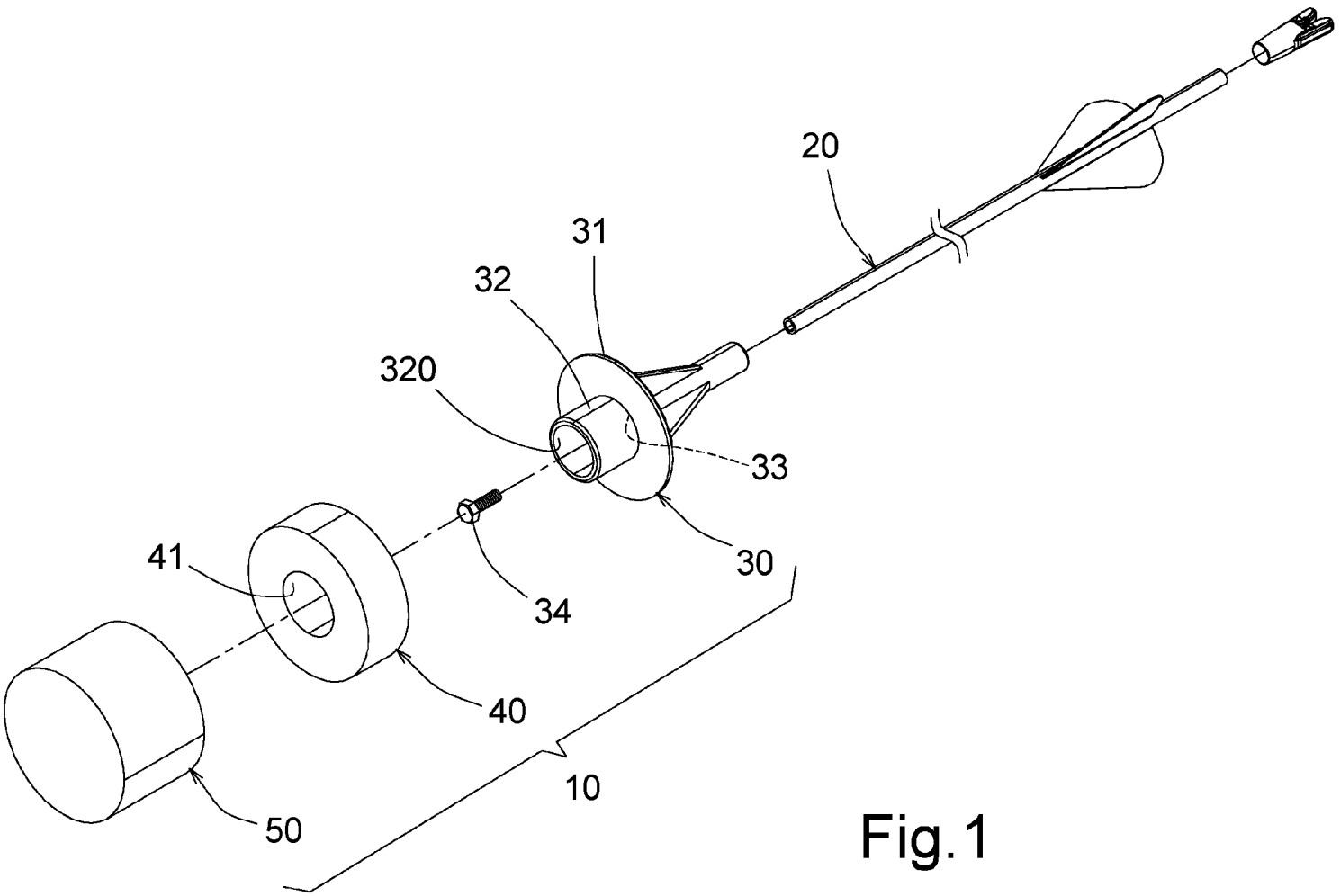
FIG. 1 is a perspective exploded view of the present invention.
Figure 2:
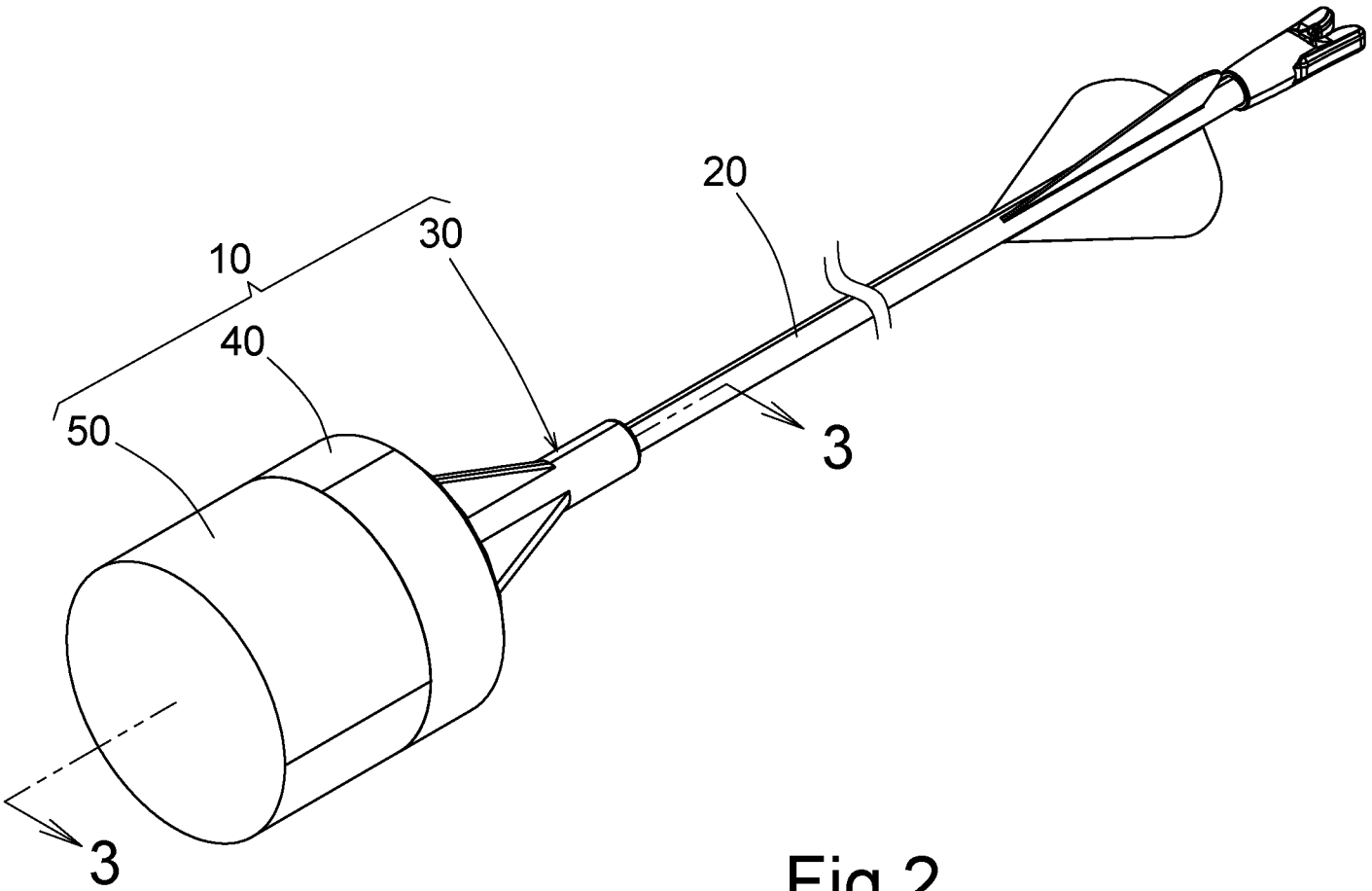
FIG. 2 is a perspective assembled view of the present invention.
Figure 3:
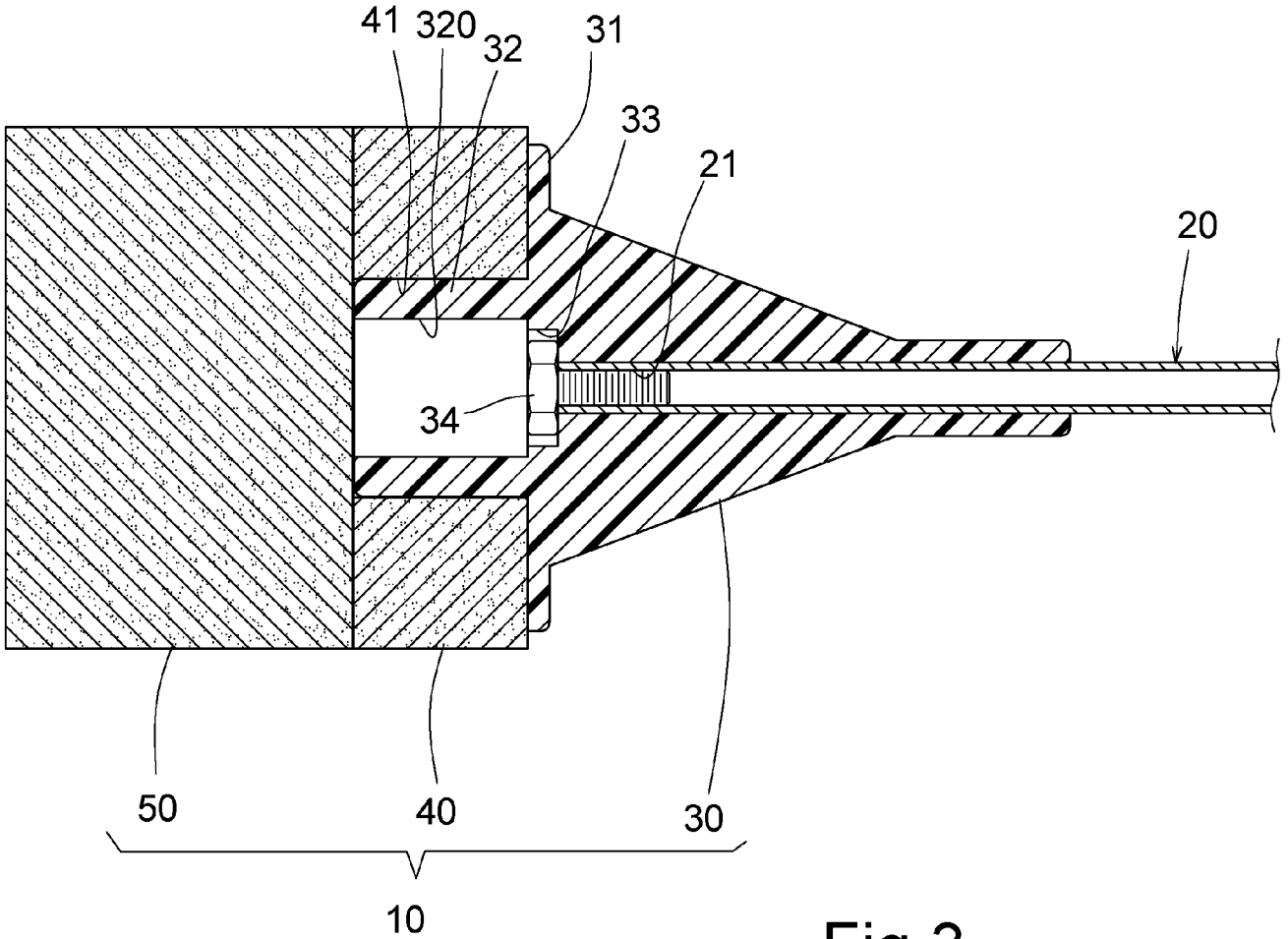
FIG. 3 is a sectional view taken along line 3-3 of FIG. 2.

Please refer to FIGS. 1 to 3. The arrowhead assembly structure 10 of the present invention is connected with a front end of an arrow rod 20. The arrowhead assembly structure 10 includes an arrowhead member 30. A first end of the arrowhead member 30 is fitted on the front end of the arrow rod 20. The arrowhead member 30 has a support flange 31 and a hub section 32. The hub section 32 axially extends from the support flange 31 toward the front end of the arrowhead member 30. The hub section 32 has a diameter smaller than an outer diameter of the support flange 31. The arrowhead assembly structure 10 further includes at least one first cushion member 40. The first cushion member 40 is formed with a central through hole 41. By means of the central through hole 41, the first cushion member 40 is fitted around the hub section 32 of the arrowhead member 30. A first end of the first cushion member 40 is adhered to the support flange 31 of the arrowhead member 30. The arrowhead assembly structure 10 further includes at least one second cushion member 50. A first end of the second cushion member 50 is adhered to a second end of the first cushion member 40.

The center of a front end of the hub section 32 is axially recessed rearwardly to form a socket 320. Accordingly, a hollow is defined among the hub section 32, the second cushion member 50, and the support flange 31. In this case, when the arrowhead hits a target, the action force applied to the second cushion member 50 will not concentrate on the center, but will distribute over the outer circumferential region projected by the support flange 31. Therefore, when the arrowhead hits a target, the large-area outer circumferential region of the second cushion member 50 will serve as a main force-bearing region to reduce the fulcrum effect. Under such circumstance, when the arrowhead hits the target, the possibility of deflection of the arrow rod 20 is minimized and the arrow rod 20 is prevented from transversely moving to strike or thrust and injure a player. Generally, in practice, when the arrowhead hits a target, the entire arrow will directly drop onto the ground and the arrow rod 20 will not deflect. In this case, the possibility of the accident that the arrow rod 20 strikes or thrusts and injures a player is minimized.

Please further refer to FIGS. 1 to 3. In the arrowhead assembly structure 10 of the present invention, the first and second cushion members 40, 50 are both elastic members made of elastic material such as silicone, rubber, sponge, foam rubber, polystyrene, fabric or any other soft material.

Please further refer to FIGS. 1 to 3. In the arrowhead assembly structure 10 of the present invention, the second cushion member 50 has an elastic constant larger than that of the first cushion member 40.

Figure 4:
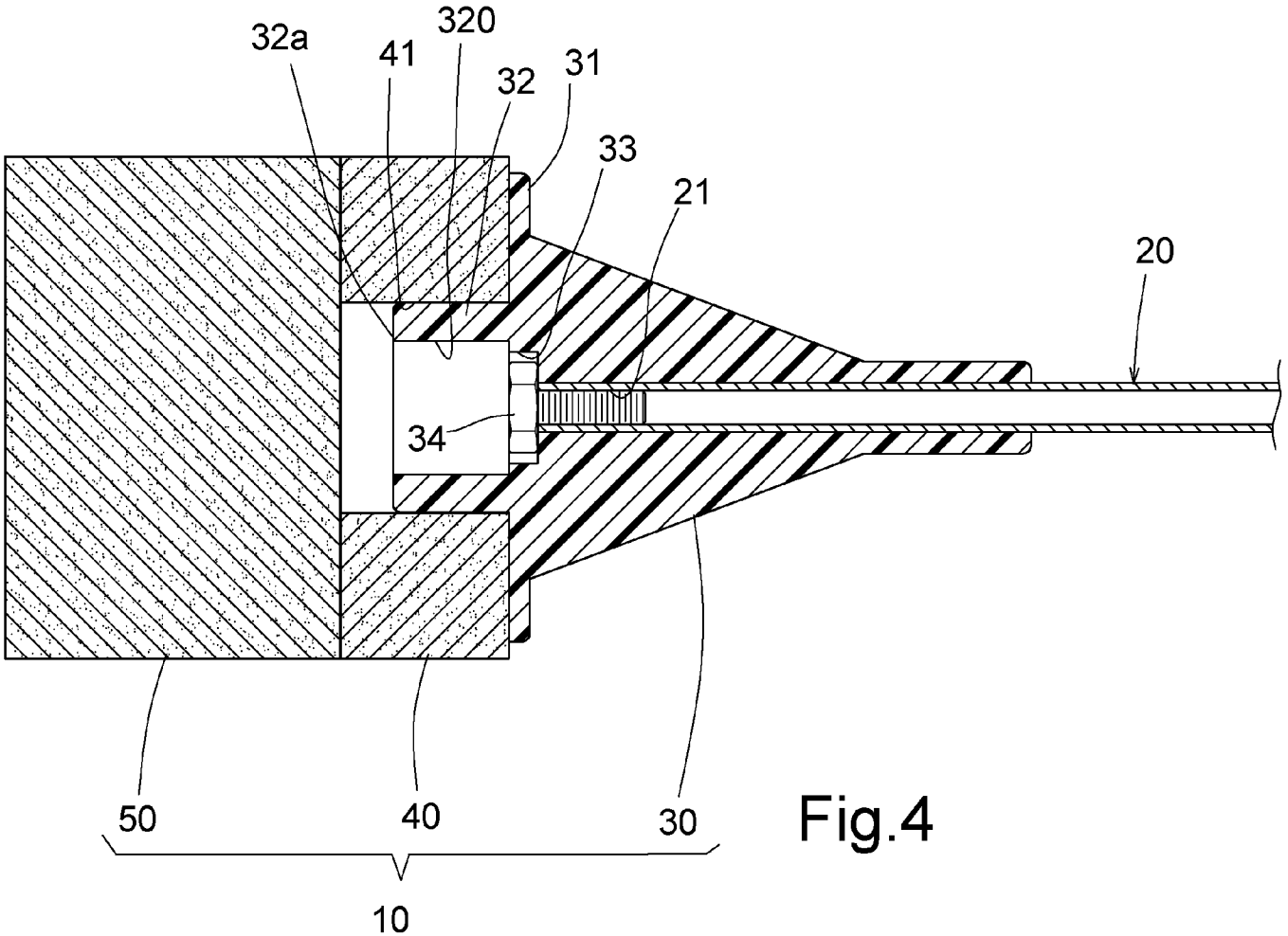
FIG. 4 is a sectional assembled view of a second embodiment of the present invention.
Figure 5:
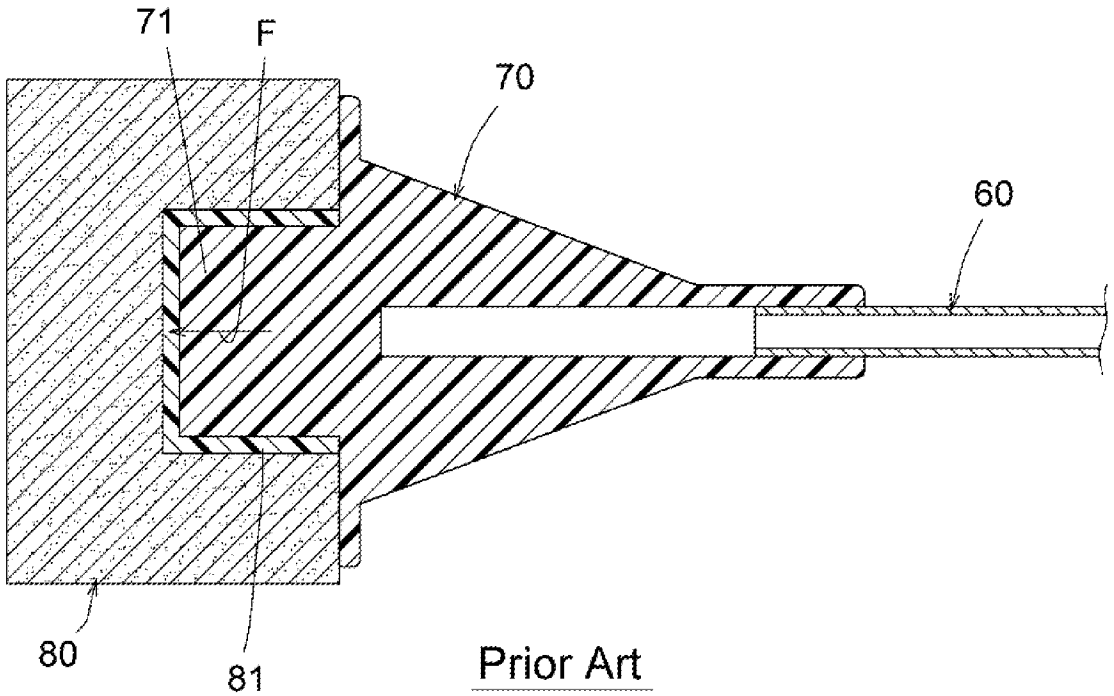
Prior Art Fig.5
FIG. 5 is a sectional view of a conventional arrowhead.

In another embodiment of the arrowhead assembly structure 10 of the present invention, the front end 32*a* of the hub section 32 of the arrowhead member 30 is not in contact with the second cushion member 50. As shown in FIG. 4, the height of the hub section 32 is smaller than the height of the first cushion member 40. Therefore, when the arrowhead hits a target, the force applied to the second cushion member 50 is directly transmitted to the first cushion member 40 of the outer circumferential region. In this case, the force will not concentrate on the center to reduce the fulcrum effect.

Please further refer to FIGS. 1 to 3. In the arrowhead assembly structure 10 of the present invention, the arrow rod 20 further has a central passage 21 formed with inner thread. The arrowhead member 30 has an inner hole 33. A bolt 34 is positioned in the inner hole 33 of the arrowhead member 30 and screwed and locked into the inner thread of the central passage 21 of the arrow rod 20. Therefore, the arrowhead member 30 is securely connected with the arrow rod 20 by the bolt 34 and the bolt 34 serves as a counterweight.

The arrowhead assembly structure 10 of the present invention has the following characteristics and advantages:

1. The action force can be distributed over a large area to avoid fulcrum effect caused by the smaller impact or collision area of the arrow rod. Therefore, in the instant of hitting a target, the arrow rod will not deflect and the possibility of the accident that the arrow rod strikes or thrusts and injures a player is minimized.
2. When the second cushion member hits an object, the second cushion member is compressed to the first cushion member to make a secondary cushioning for weakening the impact force.

The above embodiments are only used to illustrate the present invention, not intended to limit the scope thereof. Many modifications of the above embodiments can be made without departing from the spirit of the present invention.

What is claimed is:

1. An arrowhead assembly structure connected with a front end of an arrow rod, the arrowhead assembly structure comprising:

an arrowhead member, a first end of the arrowhead member being fitted on a front end of the arrow rod, the arrowhead member having a support flange and a hub section, the hub section axially extending from the support flange toward a second end of the arrowhead member, the hub section having a diameter smaller than an outer diameter of the support flange;

a least one first cushion member, the first cushion member being formed with a central through hole, by means of the central through hole, the first cushion member being fitted around the hub section of the arrowhead member; and at least one second cushion member, a first end of the second cushion member being adhered to a second end of the first cushion member; and a center of a front end of the hub section axially recessed rearwardly to form a socket, and a hollow defined among the hub section, the second cushion member and the support flange.

2. The arrowhead assembly structure as claimed in claim 1, wherein both the first and second cushion members are elastic members.

3. The arrowhead assembly structure as claimed in claim 2, wherein the second cushion member has an elastic constant larger than that of the first cushion member.

4. The arrowhead assembly structure as claimed in claim 1, wherein the front end of the hub section of the arrowhead member is not in contact with the second cushion member.

5. The arrowhead assembly structure as claimed in claim 1, wherein the hub section has a height, the height of the hub section being smaller than a height of the first cushion member.

6. The arrowhead assembly structure as claimed in claim 1, wherein the arrow rod further has a central passage formed with inner thread, the arrowhead member further having an inner hole, a bolt being positioned in the inner hole of the arrowhead member and screwed and locked into the inner thread of the central passage of the arrow rod, whereby the arrowhead member is securely connected with the arrow rod by the bolt.

7. The arrowhead assembly structure as claimed in claim 1, wherein the first cushion member is adhered to the support flange of the arrowhead member.

* * * * *